US006553595B1

(12) United States Patent
Bruntz et al.

(10) Patent No.: US 6,553,595 B1
(45) Date of Patent: Apr. 29, 2003

(54) LAUNDRY APPLIANCE WITH ENERGY SAVING FEATURE

(75) Inventors: Jordan S. Bruntz, Baxter, IA (US); Brent A. England, Newton, IA (US); Steven J. Sousek, Lincoln, NE (US)

(73) Assignee: Maytag Corporation, Newton, IA (US)

( * ) Notice: Subject to any disclaimer, the term of this patent is extended or adjusted under 35 U.S.C. 154(b) by 14 days.

(21) Appl. No.: 09/989,175

(22) Filed: Nov. 21, 2001

(51) Int. Cl.[7] ..... D06F 33/02

(52) U.S. Cl. ..... 8/158; 68/12.12; 68/12.22; 68/12.27

(58) Field of Search ..... 8/158; 68/12.03, 68/12.12, 12.19, 12.22, 12.23, 12.27

(56) References Cited

U.S. PATENT DOCUMENTS 5,560,060 A 10/1996 Dausch et al.
5,883,802 A 3/1999 Harris
6,044,510 A 4/2000 Cho
6,125,490 A 10/2000 Riechman et al.

FOREIGN PATENT DOCUMENTS

GB 2112554 * 7/1983 ..... 68/12.27

* cited by examiner

*Primary Examiner*—Philip R. Coe
(74) *Attorney, Agent, or Firm*—Diederiks & Whitelaw, PLC

(57) ABSTRACT

A vertical axis clothes washing appliance is configured to meet predetermined energy and water usage factors by establishing a balance between water temperature, water level, and wash performance parameters. In accordance with the overall invention, additional controls for the washing machine enable an energy saving hot wash cycle to be established, with this wash cycle being designed to automatically establish a wash temperature which is intermediate warm and hot water temperature settings.

17 Claims, 2 Drawing Sheets

LAUNDRY APPLIANCE WITH ENERGY SAVING FEATURE

BACKGROUND OF THE INVENTION

1. Field of the Invention

The present invention pertains to the art of laundry appliances and, more specifically, to the incorporation of an energy saving feature in a clothes washing machine.

2. Discussion of the Prior Art

In a clothes washing appliance, it is necessary for a consumer to establish parameters for a desired operating cycle. For instance, either before or after loading a tub of a washing machine with clothes to be laundered, the user must typically establish a desired wash level, a wash temperature, and an operating time for a particular cycle. Typically, these selections are made through various rotatable, sliding and/or push button controls provided on a control panel of the appliance. However, other control arrangements, such as a touch screen control, have also been proposed.

In general, there exists in the art two major designs or models for clothes washing machines, i.e., horizontal axis and vertical axis washing machines respectively. Horizontal axis machines operate on the general premise of tumbling a load of clothes through a relatively small amount of water contained in the tub of the machine. That is, the clothes are continually directed through, lifted from, and then re-directed through the water. On the other hand, a vertical axis washing machine requires a greater amount of water for a particular wash load and operates to agitate the clothes for cleaning purposes.

In addition to requiring less water on a per wash load basis, horizontal axis washing machines are generally more efficient from an energy usage standpoint than vertical axis washing machines. Based on promulgated government regulations, energy efficiency or star ratings have been established for clothes washing machines. In order to receive an energy star rating, a clothes washer must therefore meet certain energy and water usage factors. At present, the government established values are 1.26 KWH per cubic foot of wash volume (EF) and 11.0 gallons per cubic foot (WCF). Given the inherent energy efficiencies associated with horizontal axis washing machines, higher energy ratings are more easily achieved. Unfortunately, this is not the case in connection with vertical axis washing machines. However, achieving the energy star rating is still important to the viability of a vertical axis washing machine. Based on the above, there exists a need for a vertical axis washing machine which is configured in a manner which enables the energy star rating to be achieved, while still meeting consumer needs.

SUMMARY OF THE INVENTION

The present invention pertains to a vertical axis washing machine configured to meet predetermined energy and water usage factors. More particularly, a vertical axis washing machine constructed in accordance with the invention operates by establishing a balance between water temperature, water level, and wash performance. In accordance with the overall invention, additional controls for the washing machine enable an energy saving hot wash cycle to be established, with this wash cycle being designed to automatically establish a wash temperature which is intermediate warm and hot water temperature settings. Furthermore, maximum and minimum wash water levels are predetermined to meet the energy savings goal.

In accordance with the most preferred form of the invention, a maximum wash level is set at approximately 19.0 gallons, while a minimum wash level is set at 8.25 gallons. With respect to water temperatures, the energy savings temperature is established at 90° F., based on a hot temperature of approximately 120° F., a warm temperature of approximately 75° F., and a cold temperature of 60° F. Therefore, this energy savings temperature provides a slightly cooler hot water washing temperature. To enhance the convenience of establishing this setting, the energy saving mode is established via the coordination between the energy saving selection and a standard hot water washing operation.

Additional objects, features and advantages of the present invention will become more fully apparent from the following detailed description of a preferred embodiment, when taken in conjunction with the drawings wherein like reference numeral refer to corresponding parts in the several views.

DETAILED DESCRIPTION OF THE PREFERRED EMBODIMENT

Figure 1:
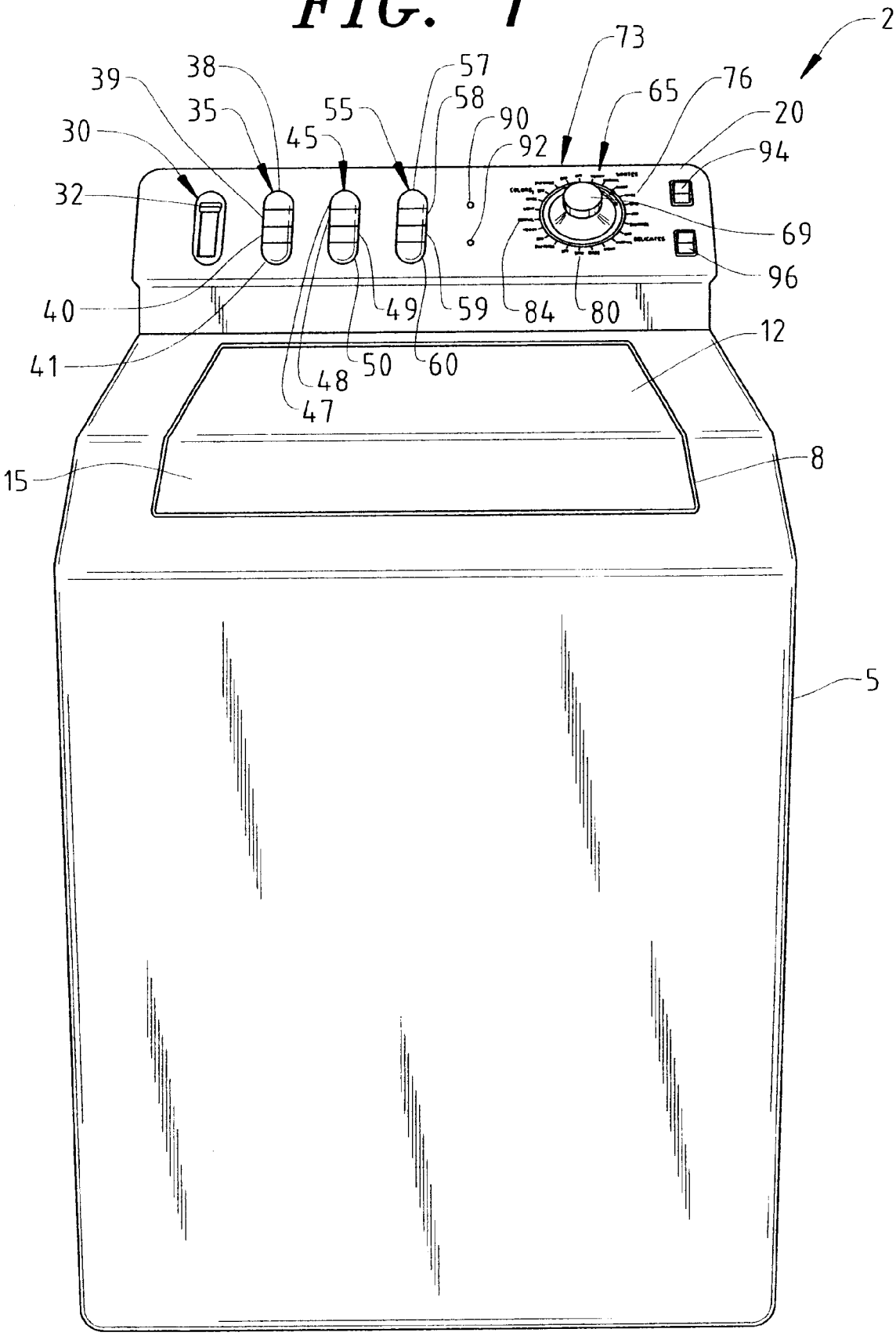
FIG. 1 is a front perspective view of a top loading, vertical axis clothes washing appliance incorporating the energy saving control feature of the present invention.

With initial reference to FIG. 1, a laundry appliance constructed in accordance with the present invention is generally indicated at 2. As shown, laundry appliance 2 constitutes a top loading, vertical axis clothes washer. Washing appliance 2 includes an outer cabinet 5 provided with an upper opening 8 that can be selectively closed by means of a pivotable lid 12. In a manner widely known in the art, lid 12 can be raised to provide access to a rotatable basket (not shown) mounted within cabinet 5, with clothes to be laundered being adapted to be placed in the basket. In the preferred embodiment shown, lid 12 includes an angled front portion 15 to enhance access to within cabinet 5.

Figure 2:
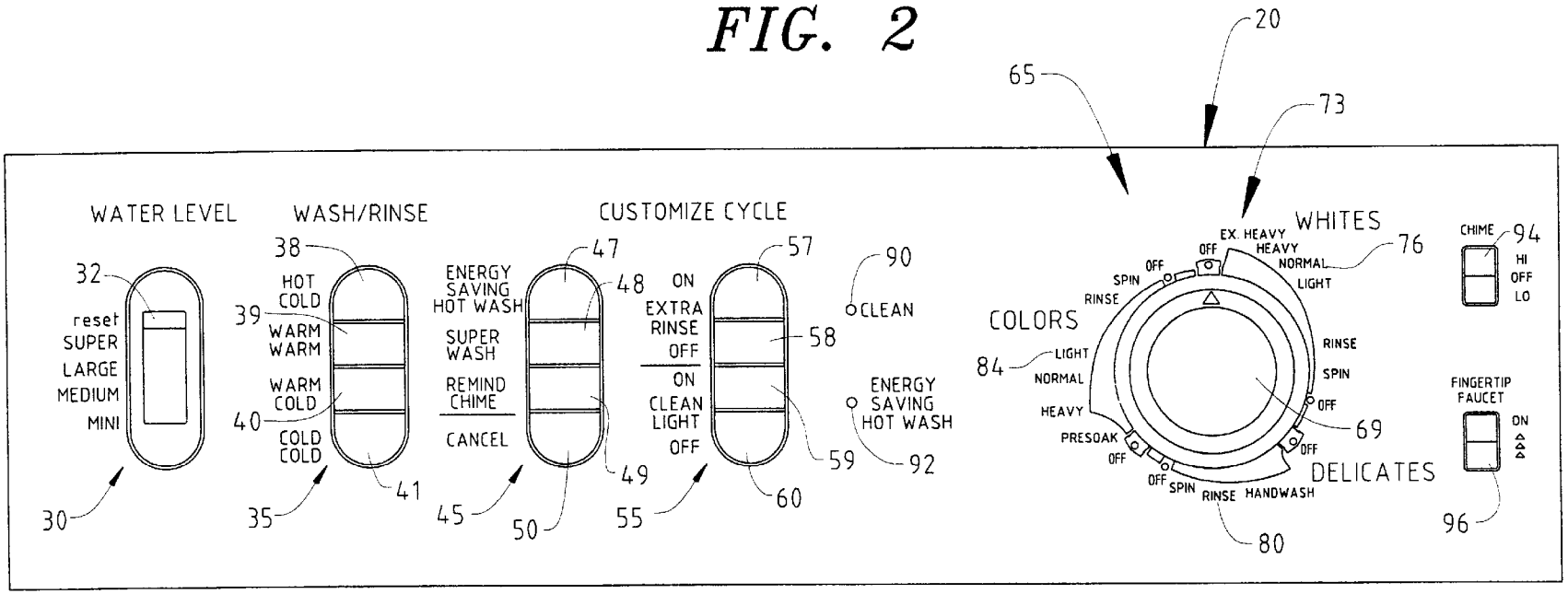
FIG. 2 is an enlarged view of a control panel portion of the clothes washing appliance of FIG. 1.

As also shown in FIG. 2, at a rear portion of cabinet 5 is arranged a control panel 20 that includes various control units which can be used to program a desired laundering operation for washing appliance 2. In the preferred embodiment shown, control panel 20 includes a first control unit 30 having a vertically shiftable knob 32. Knob 32 is adapted to be shifted between raised and lowered positions in order to enable a user of washing appliance 2 to select a desired load size. For instance, knob 32 can be shifted between mini, medium, large and super load capacity positions, as well as a potential reset position.

Control panel 20 also includes a second control unit 35 that is defined by a plurality of buttons 38–41. Second control unit 35 is provided to establish wash and rinse temperatures. Therefore, button 38 is used to establish hot/cold wash/rinse temperatures; button 39 is used to establish warm/warm wash/rinse temperatures; button 40 is used to establish warm/cold wash/rinse temperatures; and button 41 is used to establish cold/cold wash/rinse temperatures respectively.

Adjacent second control unit 35 is a third control unit 45 which is defined, in the preferred embodiment shown, by buttons 47–50. Third control unit 45 can be used by a consumer to additionally establish an energy saving hot wash cycle through button 47 or a super wash operation through the use of button 48. As will be detailed fully below after describing additional structure incorporated in washing machine 2, the invention is particularly directed to the inclusion and use of button 47 to establish an energy saving wash mode for washing appliance 2. A reminder chime can be set through button 49 and, to cancel any of these control features, button 50 is provided.

Arranged next to third control unit 45 is a fourth control unit 55 which is preferably provided to enable extra rinse and/or clean light operations to be established. More specifically, fourth control unit 55 includes a button 57 for establishing an extra rinse operation for the current washing operation, while a button 58 is used to turn off the extra rinse operation. In a similar manner, a button 59 is provided to select a clean light operation and a button 60 is provided to cancel this operation.

In addition to these operating parameters, it is also necessary to establish both a desired cycle and operational time for a laundry operation to be performed within appliance 2. To this end, washing appliance 2 is also shown to incorporate a fifth control unit 65 including a control member 69 that preferably takes the form of a rotatable knob. About control member 69 is provided graphic indicia generally indicated at 73 which, in the preferred embodiment shown, is essentially divided into first, second and third graphic zones 76, 80 and 84 respectively. First graphic zone 76 is used in connection with establishing a washing cycle for whites; second graphic zone 80 represents a washing zone for delicate clothing articles; and third graphic zone 84 represents a washing cycle selection zone for colored garments. As will be readily evident to the reader of this disclosures, the provision of indicia defined within zones around a rotatable knob within a washing machine is also quite prevalent in the art. Furthermore, the manner in which rotatable control member 69 can be used to program the type of laundry to be washed, as well as a desired washing duration, is widely known in the art such that further details thereof will not be provided here.

Disposed between fourth and fifth control units 55 and 65 is preferably provided an upper "Clean" light element 90 such as an LED or a neon lamp. Similarly, a light element 92 is provided to illuminate when an energy saving hot wash operation is established in accordance with the invention. Finally, a chime control switch 94 that can preferably be set between Hi, Low and Off positions, as well as a fingertip faucet actuating switch 96, is arranged on an opposing side of fifth control unit 65. Again, this structure is not considered part of the invention but is rather provided simply for the sake of completeness. At this point, it should be readily apparent that the particular structure used to program washing appliance 2 can vary without departing from the spirit of the invention. For instance, a touch screen display or the like, such as that disclosed in pending U.S. patent application Ser. No. 09/741,067 filed Dec. 12, 2000, and now U.S. Pat. No. 6,502,256, and entitled "Interactive Control System for a Laundry Appliance", which is incorporated herein by reference, could be readily employed. Instead, it is merely important that the user of washing appliance 2 is provided with controls which enable desired parameters, including water level, wash temperature, wash duration, and even clothes type, to be selected.

To this point, it should be recognized that the basic controls associated with first, second, fourth and fifth control units 30, 35, 55 and 65 are known in the art and not considered part of the present invention. The same is true with respect to the use and operation associated with buttons 48, 49 and 50. Therefore, no further details of these control elements will be provided here as this structure has only been described for the sake of completeness. Instead, the present invention is particularly directed to the incorporation of control buttons 38 and 47, as well as the corresponding functions performed by washing appliance 2 upon selecting an energy saving wash mode through button 47 as will now be detailed more fully below. Initially, it should be noted that the present invention has two main aspects. One aspect concerns establishing a desired balance between water temperature, water level, and wash performance in order to satisfy energy requirements. The second aspect concerns addressing perceived consumer needs and preferences in establishing the manner in which the overall energy saving wash mode can be activated or deactivated.

With respect to the first feature, the level and temperature of the water are regulated to create a synergistic result found to enable the desired energy rating to be achieved. More specifically, in accordance with the most preferred embodiment of the invention, when knob 32 is used to select a mini-load capacity washing operation, a wash water level of approximately 8.25 gallons is established, while a super load capacity position results in a 19.0 gallon operation. Medium and large load capacities are correspondingly established between these extreme values. Furthermore, the hot water temperature is preferably established at 120° F., the warm temperature at 75° F., and the cold temperature at 60° F. Furthermore, in accordance with the most preferred embodiment of the invention, a wash water temperature of 90° F. is provided as a slightly cooler hot wash water temperature for the auxiliary energy saving wash mode established through button 47 as will be discussed further below. All of these temperatures, which preferably vary only a few degrees in accordance with the invention, are established by controlling hot and/or cold water inlet valves (not shown) and sensing the actual water temperature to the tub of washing appliance 2 through the use of a thermistor (also not shown). By adjusting the opening and closing degrees of the valves, the actual temperature is maintained within a couple degrees of these specific values. The regulating of water inlet valves in this general manner is known, however, the particularly established temperatures are considered to be an important aspect of the invention, at least in combination with the established water level employed.

With respect to the second feature, the energy saving wash mode of the invention is preferably established by depressing button 47. More specifically, the energy saving hot wash mode of operation is only established when second control unit 35 is used to establish a hot wash operation by the depression of button 38, in combination with the depression of button 47. This programming arrangement functions to illuminate light element 92 and is seen to be advantageous for various reasons. Particularly, this arrangement enables washing machine 2 to actually be utilized in a more conventional manner in that the consumer will not be confused in connection with selecting the wash temperature as button 47 is not in second control unit 35. Therefore, selecting the energy saving hot wash mode automatically establishes a "hidden" wash temperature. This arrangement essentially alters the actual hot water wash temperature without user intervention. The overall programming operation is simple, as only one additional programming element, which is preferably arranged in a section of control panel 20 dedicated to customizing cycle selections and which is basically remote from second control unit 35, needs to be engaged.

Based on the above, it should be readily recognized that the present invention establishes a particular balance between the wash water temperature and water level in order to accomplish a desired energy rating, as well as wash performance, in an efficient and effective manner. Therefore, the invention establishes a particular wash water level range, in combination with a supplemental hot wash water temperature, in order to improve the efficiency of washing appliance 2 in a synergistic manner. Furthermore, the invention sets forth an advantageous, overall programming configuration which is seen to enhance customer appeal and effectiveness. Although described with respect to a preferred embodiment of the invention, it should be readily understood that various changes and/or modifications can be made to the invention without departing from the spirit thereof. Instead, the invention is only intended to be limited by the scope of the following claims.

We claim:

1. A vertical axis washing appliance adapted to receive and perform a laundering operation on a load of clothes as part of a washing operation comprising:

first control means for selecting a desired water level for the washing operation;

second control means for selecting a wash temperature for the washing operation;

third control means for selecting a wash time for the washing operation; and means for establishing an energy saving wash mode for the washing operation wherein the wash temperature selected through the second control means is automatically reduced to a lower temperature not available through the second control means.

2. The washing appliance according to claim 1, further comprising: a control panel, each of the first, second and third control means, as well as the means for establishing the energy saving wash mode, being exposed from the control panel, with said means for establishing the energy saving wash mode being spaced from the second control means on the control panel.

3. The washing appliance according to claim 1, wherein the second control means enables selection of at least hot, warm and cold temperature settings for the wash temperature, and wherein the means for establishing the energy saving wash mode can only reduce the wash temperature when the hot temperature setting is selected.

4. The washing appliance according to claim 3, wherein the lower temperature is 90° F.

5. The washing appliance according to claim 4, wherein the hot temperature setting is 120° F.

6. The washing appliance according to claim 3, wherein the hot and cold temperature settings differ by 60° F.

7. The washing appliance according to claim 1, wherein the first control means enables selection of the desired water level from a maximum of 19 gallons to a minimum of 8.25 gallons.

8. The washing appliance according to claim 7, wherein the second control means enables selection of the wash temperature from a hot wash temperature of 120° F., a warm wash temperature of 75° F., and a cold wash temperature of 60° F.

9. The washing appliance according to claim 8, wherein the lower temperature is 90° F.

10. A method of programming a vertical axis clothes washing appliance for a washing operation comprising:

selecting a desired water level for the washing operation;

selecting a wash temperature for the washing operation;

selecting a wash time for the washing operation;

establishing an energy saving wash mode for the washing operation; and automatically reducing the wash temperature to a lower temperature for the energy saving wash mode.

11. The method of claim 10, further comprising:

selecting between at least hot, warm and cold temperature settings for the wash temperature; and permitting the establishing of the energy saving wash mode only when the hot temperature setting is selected for the wash temperature.

12. The method of claim 11, further comprising: establishing the lower temperature at 90° F.

13. The method of claim 12, further comprising: establishing the hot temperature at 120° F.

14. The method of claim 11, further comprising: establishing a difference between the hot and cold temperature settings of 60° F.

15. The method of claim 10, further comprising: selecting the desired water level from a maximum of 19 gallons to a minimum of 8.25 gallons.

16. The method of claim 15, further comprising: enabling selection of the wash temperature from a hot wash temperature of 120° F., a warm wash temperature of 75° F., and a cold wash temperature of 60° F.

17. The method of claim 16, further comprising: establishing the lower temperature at 90° F.

* * * * *